US010441829B2

(12) United States Patent
Vogt et al.

(10) Patent No.: US 10,441,829 B2
(45) Date of Patent: Oct. 15, 2019

(54) PULLING ELEMENT FOR PULLING A CLOSING ELEMENT OUT OF A FILTER OF AN ESCAPE FILTER DEVICE, ESCAPE FILTER DEVICES, ESCAPE FILTER DEVICE SYSTEM AND METHOD FOR MOUNTING AN ESCAPE FILTER DEVICE SYSTEM

(71) Applicants: Dräger Safety AG & Co. KGaA, Lübeck (DE); Simon Vogt, Lübeck (DE); Michael Rosert, Timmendorfer Strand (DE); Rüdiger Müller, Stockelsdorf (DE); Joachim Radicke, Lübeck (DE)

(72) Inventors: Simon Vogt, Lübeck (DE); Michael Rosert, Timmendorfer Strand (DE); Rüdiger Müller, Stockelsdorf (DE); Joachim Radicke, Lübeck (DE)

(73) Assignee: Dräger Safety AG & Co. KGaA, Lübeck (DE)

( * ) Notice: Subject to any disclaimer, the term of this patent is extended or adjusted under 35 U.S.C. 154(b) by 981 days.

(21) Appl. No.: 14/781,670

(22) PCT Filed: Feb. 15, 2014

(86) PCT No.: PCT/EP2014/000423
§ 371 (c)(1),
(2) Date: Oct. 1, 2015

(87) PCT Pub. No.: WO2014/161623
PCT Pub. Date: Oct. 9, 2014

(65) Prior Publication Data

US 2016/0059052 A1 Mar. 3, 2016

(30) Foreign Application Priority Data

Apr. 2, 2013 (DE) ..... 10 2013 005 514

(51) Int. Cl.

| | |
|---|---|
| ***A62B 25/00*** | (2006.01) |
| ***A62B 7/10*** | (2006.01) |
| ***A62B 17/04*** | (2006.01) |
| ***B66F 19/00*** | (2006.01) |
| *A62B 23/00* | (2006.01) |
| *A62B 18/00* | (2006.01) |

(52) U.S. Cl.
CPC ..... *A62B 25/00* (2013.01); *A62B 7/10* (2013.01); *A62B 17/04* (2013.01); *B66F 19/00* (2013.01); *A62B 18/00* (2013.01); *A62B 23/00* (2013.01)

(58) Field of Classification Search
CPC ..... A62B 25/00; A62B 7/10; A62B 17/04; A62B 7/00; A62B 7/08; A62B 7/12;
(Continued)

(56) References Cited

U.S. PATENT DOCUMENTS 4,154,235 A * 5/1979 Warncke ..... A62B 17/04 128/201.25
4,467,795 A * 8/1984 Eckstein ..... A62B 23/02 128/201.25
(Continued)

FOREIGN PATENT DOCUMENTS

DE 80 15 449 U1 10/1980
DE 8015449 U1 * 10/1980 ..... A62B 25/00
(Continued)

OTHER PUBLICATIONS

English machine transation for DE8015449, espacenet.com, translated on Sep. 17, 2018.*

*Primary Examiner* — Rachel T Sippel
*Assistant Examiner* — Tu A Vo
(74) *Attorney, Agent, or Firm* — McGlew and Tuttle, P.C.

(57) ABSTRACT

A pulling element is provided for automatically pulling a closing element out of a filter of an escape filter device. An escape filter device is also provided that has a hood and a filter integrated into the hood, with at least one such pulling
(Continued)

element. An escape filter device system is also provided having such an escape filter device and a device shell. A method is provided for mounting an escape filter device system.

20 Claims, 6 Drawing Sheets

(58) Field of Classification Search
CPC .. A62B 7/14; A62B 9/00; A62B 17/00; A62B 17/08; A62B 18/00; A62B 18/003; A62B 18/006; A62B 18/02; A62B 18/025; A62B 18/04; A62B 18/045; A62B 18/08; A62B 18/06; A62B 19/00; A62B 23/00; A62B 23/02; A62B 23/025; A62B 25/005; A61M 16/105; B66F 19/00
See application file for complete search history.

(56) References Cited

U.S. PATENT DOCUMENTS 4,473,072 A * 9/1984 Walther ..... A62B 23/02 128/201.25
4,562,837 A * 1/1986 Schlobohm ..... A62B 23/02 128/206.17
4,805,608 A * 2/1989 Eckstein ..... A62B 19/00 128/202.26
4,811,728 A * 3/1989 Von Kopp ..... A62B 17/04 128/201.25
4,818,122 A * 4/1989 Arbuthnot ..... A62B 25/00 128/201.25
5,040,530 A * 8/1991 Bauer ..... A62B 17/04 128/201.25
5,115,804 A * 5/1992 Brookman ..... A62B 18/025 128/201.22
5,524,616 A * 6/1996 Smith ..... A62B 9/00 128/202.22
6,340,024 B1 * 1/2002 Brookman ..... A62B 17/04 128/201.15
7,251,841 B2 * 8/2007 Corsini ..... A62B 17/04 128/201.23

FOREIGN PATENT DOCUMENTS

GB 2 223 683 A 4/1990
WO 89/00873 A1 2/1989
WO 92/21408 A1 12/1992

* cited by examiner

PULLING ELEMENT FOR PULLING A CLOSING ELEMENT OUT OF A FILTER OF AN ESCAPE FILTER DEVICE, ESCAPE FILTER DEVICES, ESCAPE FILTER DEVICE SYSTEM AND METHOD FOR MOUNTING AN ESCAPE FILTER DEVICE SYSTEM

CROSS REFERENCE TO RELATED APPLICATIONS

This application is a U.S. National Phase Application of International Application PCT/EP2014/000423 filed Feb. 15, 2014 and claims the benefit of priority under 35 U.S.C. § 119 of German Patent Application DE 10 2013 005 514.8 filed Apr. 2, 2013, the entire contents of which are incorporated herein by reference.

FIELD OF THE INVENTION

The present invention pertains to a pulling element for pulling a closing element out of a filter of an escape filter device, an escape filter device, having a hood and a filter integrated into the hood, an escape filter device system having an escape filter device and a device shell as well as a method for mounting an escape filter device system.

BACKGROUND OF THE INVENTION

Escape filter devices, such as fire escape hoods, are respirators dependent on circulating air that are used especially for self-rescuing against such toxic gases as, for example, against carbon monoxide. I.e., escape filter devices are used, for example, for the escape of persons from burning buildings. In this connection, escape filter devices, such as fire escape hoods, can be installed in buildings, so-called stationary escape filter devices, or they are carried along by firefighters for evacuating persons, so-called carry-along escape filter devices. Unlike compressed-air-operated respirators, an escape filter device does not, however, protect against oxygen deficiency in the ambient air.

Stationary escape filter devices have a hood and a filter integrated into the hood. A catalytic filter is used for the protective action against carbon monoxide (CO). To ensure that the filter of an escape filter device is usable, this filter must be protected before the mission against atmospheric oxygen and mechanical stresses before its intended use.

The reason for a vacuum-tight closing of the filter is Hopcalite. This chemical catalyst essentially provides for the filter performance. At room temperature, Hopcalite catalyzes the oxidation of toxic carbon monoxide with oxygen into comparatively harmless carbon dioxide. Since Hopcalite reacts in conjunction with air, the filter must, in order to maintain its separation performance, be closed in an airtight manner. Almost all manufacturers of escape filter devices solve the problem to the effect that they weld the entire escape filter device or the complete escape hood in a vacuum-tight manner in a barrier layer bag, usually an aluminum barrier layer bag. After the barrier layer bag was removed from a hard or soft device shell, the barrier layer bag must be torn open manually by hand, usually at a predetermined marking.

As an alternative to barrier layer bags, it is possible to directly close only the filter, i.e., the filter inlet side and the filter outlet side, each by means of a closing system, especially a plug and thus to make a welding superfluous. If these closing systems are removed, the filter is activated and a chemical process is started in the Hopcalite, which cannot be stopped. An unintentional activation of the filter must be avoided here. In such escape filter devices, the closing systems, especially the filter plugs, are manually pulled from the filter inlet side and filter outlet side by means of a fabric strap or two fabric straps. The drawback in this case is that the user of such an escape filter device must know where and how he must grasp and pull the at least one fabric strap. If the user does not know what the rule is, valuable time can be lost in the case of use, for example, in the case of fire. The user would have to first read instructions and explanations in order to use the escape filter device correctly. If the instructions and explanations are in a language that the user does not know, it may happen that the user cannot use the escape filter device at all.

Both means for accomplishing the prior-art escape filter devices require the manual intervention of the user and are consequently susceptible to an inappropriate use.

SUMMARY OF THE INVENTION

Therefore, an object of the present invention is to at least partially eliminate the above-described drawbacks in escape filter devices, such as escape hoods. In particular, the object of the present invention is to ensure in a simple and cost-effective manner that escape filter devices are automatically correctly usable in their use. In particular, a 100% activation of the filter shall take place automatically during the intended use of the escape filter device.

The above object is accomplished by a pulling element according to the present invention. In this case, features and details that are described in connection with the pulling element according to the present invention also apply in connection with the escape filter device according to the present invention, with the escape filter device system according to the present invention and with the method according to the present invention and vice versa, so that reference is or can always be made mutually with regard to the disclosure on the individual aspects of the present invention.

According to a first aspect of the present invention, the mentioned object is accomplished by a pulling element for pulling a closing element out of a filter of an escape filter device, which is arranged in a device shell in a resting position with a resting distance to the device shell, wherein the escape filter device can be moved into a removal position with an increased removal distance to the resting distance in relation to the device shell. In this case, the pulling element is characterized in that it has a first fastening section for fastening the pulling element to the closing element and a second fastening section for fastening on an inner side of the device shell, wherein the two fastening sections have a fastening distance to one another, which is smaller than or equal to the removal distance.

An automatic pulling of a closing element, such as a plug, out of a filter of an escape filter device and thus an activation of the filter of the escape filter device is possible due to a pulling element of such a design. I.e., due to pulling elements of such a design, it can be ensured in a simple and cost-effective manner that escape filter devices, which are arranged in a device shell, are automatically correctly usable in their use. The pulling elements make possible it that when the device shell, in which an escape filter device is arranged, is opened, a first closing element of the filter of the escape filter device is pulled out of the filter, and that, when the escape filter device is removed from the device shell, a second closing element is pulled out of the filter of the escape filter device. A first pulling element has a first fastening section for fastening the pulling element to a first closing element and a second fastening section for fastening to a first point on an inner side of the device shell, especially a device shell bottom side. The first closing element of a filter can be connected to the device shell, especially to a device shell bottom side, via the two fastening sections of the first pulling element. If the escape filter device is in a resting position with a resting distance to the inner side of the device shell in the device shell, then the two fastening sections of the first pulling element have a first fastening distance to one another. This first fastening distance is smaller than or equal to the removal distance that the escape filter device takes up in relation to the device shell in a removal position. The same applies to the second pulling element. Also, this second pulling element has a first fastening section for fastening the second pulling element to a second closing element of the filter and a second fastening section for fastening to a second point on the inner side of the device shell.

I.e., a second pulling element may be designed in such a way and be arranged in a device shell in such a way that this pulling element is tensioned when the device shell is opened and pulls the second closing element connected to it out of the filter. A first pulling element can be designed and be arranged within the device shell in such a way that this pulling element pulls the first closing element out of the filter when the escape filter device is removed from the device shell.

A closing element in the sense of the present invention is designed in such a way that it can seal a filter inlet side of the filter or a filter outlet side of a filter of an escape filter device in a gas-tight manner. A closing element is preferably designed as a plug, in particular as a rubber plug. If closing elements are arranged on the filter inlet side and on the filter outlet side of a filter, the filter, especially the Hopcalite arranged in the filter, cannot be activated, so that a chemical process cannot be started. As long as an escape filter device is arranged in a resting position in a device shell and the device shell is closed, the closing elements of the filter cannot be pulled by the pulling elements out of the filter. Only when the device shell is opened or when the escape filter device is removed from the device shell are the pulling elements tensioned, so that an opening force is exerted via the pulling elements on the closing elements and consequently the closing elements can be pulled out of the filter.

A device shell in the sense of the present invention can be designed as soft or hard. Further, a device shell in the sense of the present invention may be closed and opened. In the closed state, the device shell encloses the escape filter device and hence protects same especially against mechanical stresses and other environmental effects. Opened state means that the device shell can be opened in such a way that the escape filter device can be removed from the device shell in a simple manner. The device shell can be opened extensively, so that the escape filter device does not get caught in an opening gap. A soft device shell may be, for example, a fabric pocket or a rubber pocket. A fabric pocket may be closed and opened, for example, with a zipper closure. A zipper closure or snap closures are also conceivable in case of a rubber pocket. A hard device shell can be made of metal or hard plastic, for example, and be opened and closed similar to a suitcase or a lunch box. The device shell may have a one-component or multi-component, especially two-component design.

A pulling element according to the present invention is especially designed in such a way that it is inflexible in its length. As a result, it is ensured that when the pulling element is tensioned or when a tensile force is exerted on the pulling element, this element remains unchanged in its length. A fastening section may also be designed by a knot at the ends of the pulling element.

A pulling element may be designed as inflexible. For example, a pulling element may be designed as a rod. Thus, a first fastening section of the pulling element having an inflexible design may be fastened to a closing element and a second fastening section may be fastened to the inner side of the device shell. To ensure that the pulling element having an inflexible design does not break, for example, the first fastening section of the inflexible pulling element can be arranged on a closing element by means of a joint. The second fastening section of the pulling element with an inflexible design can be fastened, especially clamped, hinged or locked on the inner side of the device shell. Preferably, the inflexible pulling element is designed in such a way that the second fastening section of the pulling element is automatically fastened on the inner side of the device shell during the closing of the device shell. For this, the inflexible pulling element, especially the second fastening section, can be guided on the inner side of the device shell, for example, in a guide means or in a groove, until this second fastening section is automatically fastened, and especially locked, in a fastening position on the inner side of the device shell.

As an alternative thereto, a pulling element that is designed as flexible is preferred. Flexible in the sense of the present invention here means that the pulling element can be, for example, bent, rotated and/or stretched. The pulling element is not flexible in its linear extension, however. Thus, a pulling element having a flexible design may be made of fabric, but also plastic or wire. A pulling element having a flexible design may especially be simply arranged within the device shell, when the escape filter device has taken up its resting position and the device shell is closed. A pulling element having a flexible design makes possible a simple fastening of the first fastening section to a closing element of a filter and of the second fastening section on the inner side of the device shell. Thus, a pulling element having a flexible design, which has a first barb as a first fastening section and a second barb as a second fastening section, can be simply arranged on a pulling element fastening device of a closing element or on a pulling element holding device on the inner side of the device shell in such a way that the two fastening sections, after their fastening to one another, take up a defined fastening distance, which is smaller than or equal to a removal distance. As a result, it is ensured that the closing elements are not pulled out of the filter by the pulling elements in the resting position of the escape filter device and with the device shell closed.

The fastening sections of a pulling element may be designed in various ways. For example, a first fastening section may be formed by a knot in the pulling element. I.e., in a simple embodiment of a pulling element, a first end of the pulling element, preferably of a pulling strap, can be fastened to a closing element, especially to a pulling element fastening device of a closing element, by means of a knotting.

However, provisions may preferably be made in a pulling element for the first and/or the second fastening section to be designed as a snap-in element. A fastening section designed as a snap-in element may be, for example, a snap hook, a snap-in projection or even a snap fastener. A first fastening section having such a design may be fixed to a closing element in a simple manner, when the device shell is opened. The fastening of the second fastening section on the inner side of the device shell is more difficult. Thus, during the closing of the device shell, the end of the pulling element not fastened to the closing element can be pulled out of the barely opened slot between a device shell bottom side and a device shell top side and thereby the second fastening section of the pulling element can be locked on the inner side of the device shell, especially to a pulling element holding device on the inner side of the device shell. If the pulling element is designed as an inflexible pulling element, the locking can take place automatically during the closing of the device shell. For example, the second fastening section of a pulling element can be guided in a guide or a groove on the inner side of the device shell until the second fastening section designed as a snap-in element locks on the inner side of the device shell. After the fastening of the two fastening sections of a pulling element, the fastening distance is defined and a closing element is coupled with the inner side of the device shell. If the device shell is opened and the escape filter device is removed from the device shell, the closing elements are removed from the filter by means of the pulling elements, as soon as the removal distance of the escape filter device to the inner side is greater than the fastening distance.

According to a preferred variant of the present invention, provisions may be made in a pulling element for the first and/or the second fastening section to be designed as flexible barbs. In such a pulling element, the pulling element fastening devices on the closing elements or the pulling element holding devices on the inner side of the device shell are preferably designed in such a way that these each have an opening for guiding through the pulling element. In particular, the pulling element fastening devices or the pulling element holding devices are designed as a locking funnel. A pulling element, in which the fastening elements are designed as flexible barbs, can be fastened in a simple manner to the pulling element fastening devices or the pulling element holding devices. Thus, for example, a first side of the pulling element, to which a first barb is assigned, can be pulled through a locking funnel on the closing element of a filter until the first barb, after pulling through the locking funnel, locks behind this. The second end of the pulling element can be pulled through the locking funnel on the inner side of the device shell until, after pulling through the second barb through the locking funnel, this barb locks behind the locking funnel. By locking the two barbs of the pulling element at the respective locking funnels on a closing element and on the inner side of the device shell, it is ensured that the barbs are arranged with a specific fastening distance to one another. The mounting of the pulling element can be carried out when an escape filter device in the resting position is arranged within the device shell. If the device shell is subsequently opened, then the pulling element is tensioned between the two locking funnels and, when a removal distance is reached between the device shell and a closing element of the filter, the corresponding closing element is pulled or torn out of the filter.

A pulling element of such a design especially makes possible the locking of the second fastening element, i.e., of the second barb, on the inner side of the device shell, when this device shell is already almost closed. By pulling at the second end of the pulling element, the second barb can be pulled through a locking funnel on the inner side of the device shell and consequently the fastening distance between the two fastening elements of the pulling element can be set. The free end of the pulling element can either be inserted into the interior of the device shell or cut off after guiding the second barb through the locking funnel on the inner side of the device shell before the device shell is closed entirely.

Further, a pulling element, which has a stopping element between the first and the second fastening sections, is preferred. The stopping element makes it possible to limit the pulling of the pulling strap through the opening of a pulling element holding device, especially of a locking funnel, on the inner side of the device shell. The path of the pulling element, and especially of the pulling strap, in the locking funnel is limited by the stopping element at the pulling elements/pulling strap. As a result, it is ensured that the closing element is fastened to the first fastening element of the pulling element, while the fastening of the second fastening element on the inner side of the device shell cannot be pulled out of the filter. The stopping element is used, so to speak, as a mounting stop for mounting the pulling element on the pulling element holding device on the inner side of the device shell.

The pulling strap can be pulled "at the long end" until the stopping of the stopping element at the pulling element holding device on the inner side of the device shell. If the stopping element stops at the pulling element holding device, the pulling strap cannot be pulled further. As a result, it is ensured that the second fastening element of the pulling strap, here in the form of a flexible barb, was pulled through the opening of the pulling element holding device, especially the locking funnel, and is locked on the inner side of the device shell. After that, the barb at the pulling strap facing the locking funnel on the inner side of the device shell has reached its final position. From this time on, the function of the pulling strap is activated and a removal of the escape filter device is no longer possible without activating the filter, i.e., without a removal of the closing elements from the filter inlet side and the filter outlet side.

According to a preferred variant of the present invention, provisions may be made in a pulling element for the pulling element to have a mounting control element and/or a gripping element at one end of the pulling element. The mounting control element is preferably arranged at the second end or in the vicinity of the second end of the pulling element. The first end of the pulling element can be fastened to the closing element. The mounting control element is used to indicate the fastening of the second fastening element on the inner side of the device shell outside of the device shell. I.e., the pulling element and the mounting control element are designed and coordinated with the size of the device shell in such a way that the mounting control element is guided at a window in the device shell or out of the device shell, when the second fastening element is fastened in the correct position on the inner side of the device shell. The clearly locked position of the pulling strap may be indicated, for example, by an optical marking on the pulling strap outside of the device shell. The mounting control element may also be an acoustic mounting control element instead of an optical marking, such as a color marking or a projection on the pulling element. For example, the fastening, especially the locking of the second fastening element on the inner side of the device shell can be indicated by a sound. If the person performing the mounting hears the locking, then he knows that the second fastening element is fastened correctly. For simplifying the pulling of the pulling element, especially of the pulling strap, a gripping element can be provided at the second end of the pulling element. This may be embodied by a loop at the end of the pulling element.

The pulling element/pulling strap protruding during the closing process of the device shell may be positioned in the device shell in such a way that there is no hindrance during the opening of the device shell and during the removal of the escape filter device. It is also conceivable to shorten the pulling element/pulling strap at a suitable point after mounting the fastening elements on the closing element of the filter and on the inner side of the device shell, e.g., by means of cutting off.

According to a second aspect of the present invention, the object is accomplished by an escape filter device, having a hood and a filter integrated into the hood, which filter has a filter inlet side and a filter outlet side, wherein the filter inlet side is closed by means of a first closing element in a gas-tight manner and the filter outlet side is closed by means of a second closing element in a gas-tight manner, and wherein a pulling element is arranged on at least one closing element for pulling the respective closing element out of the filter. The escape filter device is characterized in that each pulling element is designed according to the first aspect of the present invention.

Such an escape filter device with at least one pulling element offers the same advantages, as they have been explained in detail regarding the pulling elements according to the first aspect of the present invention. I.e., an escape filter device of such a design, because of its at least one pulling element, may be arranged on at least one closing element of the filter in a resting position within a device shell in such a way that, during the opening of the device shell via the at least one pulling element, the at least one closing element is automatically pulled out of the filter, so that a partial activation of the filter of the escape filter device takes place automatically when the device shell is opened. As a result, it is at least ensured that one of the closing elements of the filter is already pulled out of the filter when the device shell is opened, so that a user of the escape filter device does not have to pull at least this closing element out of the filter later.

However, an escape filter device, in which a pulling element is arranged at each of the two closing elements for pulling the respective closing element out of the filter, is preferred. In such an escape filter device, it is ensured that both the first closing element is pulled out of the filter during the opening of the device and the second closing element is also pulled out of the filter during the removal of the escape filter device from the device shell. As a result, a 100% activation of the filter takes place for the intended use of the escape filter device. The activation of the filter takes place without irritations in the usual handling process during the opening of the device shell and during the removal of the escape filter device from the device shell.

The hood of such an escape filter device can be designed in various ways. For example, the hood may only be designed as a mouthpiece fitting, which goes only over the nose and the mouth of the user. As an alternative thereto, the hood may be designed as a quarter mask, half mask or full mask. The hood is preferably made of an elastomer. As an alternative or in addition, provisions may be made for the hood to have a fireproof coating on the outside. Furthermore, the hood may have a window. This is especially necessary if the hood is designed as a half mask or full mask. The filter integrated into the hood is preferably a particle-CO filter with Hopcalite. The first closing element and/or the second closing element are preferably designed as plugs, especially as rubber plugs. These are used for closing the filter outlet side and the filter inlet side of the filter in a gas-tight manner. As already explained according to the first aspect of the present invention, a pulling element may be designed as inflexible or flexible. Each pulling element is fastened to one of the closing elements via its first fastening section. The fastening can take place in the simplest case by means of a knot. Preferably, the first fastening section of a pulling element is fastened to the respective closing element via a snap-in element, for example, a barb, a snap connection or a snap fastener. Depending on whether the pulling element is designed as inflexible or flexible, the second fastening element may have a different design. If the pulling element is designed as inflexible, then the second fastening section can be designed, for example, as a snap connection, snap-in element or snap fastener. If the pulling element is designed as flexible, for example, as a pulling strap, then the second fastening element may advantageously be designed as a barb, which is designed as flexible.

An escape filter device of such a design makes it possible for the closing elements of the filter to be able to be coupled with the inner side of the device shell during the mounting of the air filter device in a device shell in such a way that the closing elements are pulled out of the filter during the opening of the device shell or during the removal of the escape filter device from the device shell, as a result of which this filter is automatically activated. A user of the escape filter device then does not have to worry about how the escape filter device has to be made usable. The user only has to put on the mask of the escape filter device correctly. The at least one pulling element of the escape filter device makes it possible, after the mounting of the escape filter device, for the two fastening sections of a pulling element to have such a fastening distance to one another, which is smaller than or equal to the removal distance of the device shell to the escape filter device. I.e., as long as the escape filter device is arranged within the closed device shell in the resting position and the device shell remains closed, the pulling elements are not accessible and the closing elements also cannot be pulled out of the filter. Only when the device shell is opened or the escape filter device is removed from the device shell are the closing elements retained by the device shell because of the coupling of the closing elements via the pulling elements with the inner side of the device shell, so that the filter of the escape filter device is activated only then.

According to a preferred variant of the present invention, provisions may be made in an escape filter device for each closing element coupled with a pulling element to have a pulling element fastening device. This pulling element fastening device is used for fastening the first fastening element of a pulling element. I.e., a pulling element fastening device on a closing element is used as counterpart to the first fastening section of a pulling element. In a simple embodiment, a pulling element fastening device may have an eyelet, which is used for forming a knot of the first fastening section of a pulling element. As an alternative thereto, a pulling element fastening device on a closing element may be designed as a snap-in element, as a snap hook, as a snap fastener or as a clamping element. All these elements are used for fixing or retaining the first end of the pulling element on a closing element. A pulling element fastening device is especially designed in such a way that it prevents the pulling element from being able to be further pulled from a certain point. I.e., a pulling element fastening device retains the first end of the pulling element. A pulling element fastening device is especially preferably designed as a locking funnel. A locking funnel is especially advantageous when the pulling element is designed as a flexible pulling element, especially as a pulling strap and the fastening elements of the pulling element are designed as flexible barbs. The locking funnel is used to enable the first end of the pulling element to be pulled through the locking funnel, wherein the flexible barb is arranged at the first end of the pulling element in such a way that a return of the first end of the pulling element in the other direction through the locking funnel is not possible. When the pulling element is pulled back in the other direction, the flexible barb stops at the locking funnel, but cannot be pulled through same. An escape filter device of such a design makes possible in a simple way the fastening or a retaining of a first fastening section of a pulling element on a closing element, which is used for closing a filter inlet side or a filter outlet side.

According to a third aspect of the present invention, the object is accomplished by an escape filter device system, having an escape filter device according to the second aspect of the present invention, and a device shell, in which the escape filter device can be arranged in the resting position and which can be opened for transferring the escape filter device into a removal position. On the inner side of the device shell of the escape filter device system is arranged at least one pulling element holding device for fastening the second fastening section of at least one pulling element. In this connection, the at least one pulling element and the at least one pulling element holding device are designed and coordinated with one another in such a way that when the device shell is opened, the at least one closing element is automatically pulled out of the filter upon reaching the removal distance between the device shell and the escape filter device. Such an escape filter device system offers the same advantages as they have been described in detail according to the first aspect concerning a pulling element or in detail according to the second aspect concerning an escape filter device.

In such an escape filter device system, the escape filter device is located in a resting position, when the device shell of the escape filter device system is closed. In the resting position, the escape filter device, especially the filter with the closing elements, has a so-called resting distance to the inner side of the device shell. The resting distance amounts preferably to less than 5 cm, especially less than 3 cm, to the inner side of the device shell. The escape filter device can be transferred from the resting position into the removal position. This takes place when the device shell is opened. I.e., a removal position is already reached when, for example, a device shell top side of the device shell is opened, and the distance between this device shell top side and the escape filter device is increased as a result. The removal distance between the device shell or device shell top side and the escape filter device is reached when this removal distance is greater than the fastening distance of the pulling element between the closing element and the device shell, especially the device shell top side. By means of the special mounting method the fastening distance may be set to be really small, especially less than 10 cm, and preferably less than 6 cm. A removal position is also reached when the escape filter device is removed from the device shell, especially from the device shell bottom side. Here as well, the distance between the escape filter device, especially the filter of the escape filter device and the inner side of the device shell bottom side is increased. If the distance between the escape filter device and the device shell bottom side is greater than the fastening distance between the two fastening locations of the second pulling element, which is coupled between the closing element and the device shell bottom side, then the removal distance is reached and the corresponding closing element is pulled out of the filter.

The device shell of the escape filter device system can be designed as soft or hard. Such an escape filter device system makes it possible that a defined opening force of the pulling elements can be exerted on the closing elements by opening the device shell by means of a force deflection. The fastening sections of a pulling element, the pulling element fastening device of a closing element and the pulling element holding device on the inner side of the device shell are designed and coordinated with one another in such a way that after completion of the mounting process of the escape filter device system and the closing of the device shell, it is ensured that the at least one pulling element is tensioned upon opening the device shell and upon reaching a defined degree of opening of the device shell and thus pulls out the closing element on one side of the filter. The pulling element holding devices on the inner side of the device shell are used as counterpart to the second fastening sections of the pulling elements. A device shell of an escape filter device system has at least one pulling element holding device. The pulling element holding device may be designed as a snap-in element, as a snap hook, as a snap fastener, as a clamping element, especially as a locking funnel for flexible barbs of the pulling element. Preferably, the device shell has two pulling element holding devices, which are advantageously arranged on two opposite sides on the inner side of the device shell. A pulling element holding device may be designed as a stop for a stopping element of a pulling element. I.e., a pulling element holding device is especially designed in such a way that it retains the pulling element at least in a pulling direction after the fastening of the second fastening element of a pulling element. If the pulling element additionally has a stopping element, the pulling element holding device may be additionally designed in such a way that it is used as a stop for the stopping element, when the pulling element is pulled in the opposite direction.

According to a preferred variant of the present invention, provisions may be made in an escape filter device system for the device shell to have a device shell bottom side and a device shell top side, which are pivotably connected to one another, wherein the at least one holding device is arranged on the device shell top side and/or on the device shell bottom side. Preferably, an escape filter device system has two pulling element holding devices, wherein a first pulling element holding device is arranged on the device shell bottom side and a second pulling element holding device is arranged on the device shell top side. The escape filter device is arranged in the resting position within the device shell in such a way that a first closing element is preferably provided in the vicinity of the pulling element holding device on the device shell bottom side and a second closing element is arranged in the vicinity of the pulling element holding device on the device shell top side. As a result, the respective closing element can simply be coupled with the corresponding pulling element holding device assigned to it via a pulling element each. The fastening distance may be kept small. This coupling takes place for at least one of the pulling elements at the end of the mounting position, i.e., shortly before the closing of the device shell top side on the device shell bottom side.

The device shell bottom side and the device shell top side may be made of a soft plastic or a fabric. However, an escape filter device system, in which the device shell bottom side and the device shell top side are designed as hard, is preferred. Preferably, the device shell bottom side and the device shell top side are arranged pivotably on one another via a hinge for the closing and opening of the device shell.

A device shell of a hard design makes possible a defined opening of the device shell top side from the device shell bottom side and thus a defined tensioning and pulling out of the pulling elements, since the device shell top side and the device shell bottom side are not flexible during the opening or during the pulling out of the escape filter device.

In a preferred escape filter device system, provisions may be made to provide guides, especially grooves, for guiding the pulling elements, especially the second fastening elements, on the inner side of the device shell. Such a design of the inner side of the device shell is advantageous when at least one pulling element that is designed as inflexible is used. Thus, for example, a pulling element with an inflexible design, which is hinged to a closing element, can be guided in a guide or a groove on the inner side of the device shell half, until the second fastening element of the pulling element is fastened, especially locked, in a pulling element holding device on the inner side of the device shell.

Furthermore, provisions may be made in an escape filter device system for the device shell to have a closing element for closing and opening the device shell, especially for closing and opening the device shell bottom side and the device shell top side. As a result, it is ensured that at the end of the closing of the device shell, the shell is closed with certainty. A seal may especially additionally be provided at the closing element as an indicator against unintentional opening. As a result, it is ensured that the filter of the escape filter device can, moreover, be activated and has not already been activated. The closing element itself can be designed as an opening strap or may additionally have an opening strap, so that the device shell can be opened easily. Advantageously, the closing element can be designed in such a way that a positive-locking connection between the device shell bottom side and the device shell top side can take place via a snap connection.

According to a further preferred variant of the present invention, provisions may be made in an escape filter device system for a spring element to be arranged on the inner side of the device shell, which spring element, with the device shell closed, presses with a spring action against the inner sides of the device shell bottom side and the device shell top side. As a result, it is ensured that when opening the device shell, the device shell top side is pressed away from the device shell bottom side, so that the removal distance between the respective device shell side and the escape filter device is reached quickly.

Furthermore, provisions can be made in a preferred escape filter device system for this system to have a retaining device for retaining the escape filter device, especially on the device shell bottom side. The retaining mechanism, which may be formed, for example, by a Velcro fastener, is used for "holding" the escape filter device "in position," for example, on the device shell bottom side and thus eliminates a telescoping of the escape filter device. Further, upon opening of the device shell, especially upon pivoting of the device shell top side from the device shell bottom side, the escape filter device can consequently be prevented from simply falling out and possibly being damaged as a result. The retaining device is preferably designed in such a way that it does not retain, but rather automatically opens the escape filter device during the removal of the escape filter device from the device shell bottom side, and consequently also makes possible a pulling out of the second closing element from the filter. The retaining device is preferably designed as a reclosable system.

According to a last aspect of the present invention, the object is accomplished by a method for the mounting of an escape filter device system according to the third aspect of the present invention. In this connection, the method for mounting an escape filter device system is characterized by the following mounting steps:

Fastening of the first fastening section of the first pulling element to the first closing element, and fastening of the second fastening section of the first pulling element to a first position on the inner side of the device shell.

The sequence of these two mounting steps makes no difference, so that the second fastening section may also first be fastened on the inner side of the device and then the first fastening section may be fastened to the first closing element.

Further, the method is characterized by the following mounting steps:

Fastening of the first fastening section of the second pulling element to the second closing element.

This mounting step may also be carried out before the previous mounting steps.

Subsequently, the following mounting steps are carried out:

Closing of the device shell until reaching a mounting position for fastening the second fastening section of the second pulling element on the inner side of the device shell, wherein the device shell is not yet completely closed in the mounting position and fastening of the second fastening section of the second pulling element at a second position on the inner side of the device shell, and complete closing of the device shell.

It is guaranteed by means of such a method for mounting an escape filter device system that when the device shell is opened and the escape filter device is removed from the device shell, a 100% activation of the filter of the escape filter device takes place automatically. By the fastening of the second fastening section of the second pulling element taking place at a second position on the inner side of the device shell only when a mounting position of the device shell is reached, i.e., shortly before the closing of the device shell, it can be ensured that the fastening distance of the two fastening sections of at least the second pulling element is relatively small, so that the removal distance that is necessary for pulling a closing element out of the filter is reached relatively quickly when the device shell is opened.

By means of such a method for mounting an escape filter device system, the closing elements of the filter can be coupled on the inner side of the device shell in such a way that a simple automatic pulling out of the closing elements takes place both when the device shell is opened and when the escape filter device is removed from the device shell. The fastening distance of the fastening elements of the pulling elements, which are used for coupling the closing elements and the inner side of the device shell, can be set to be relatively short in such a mounting method, so that a pulling of the closing elements out of the filter by means of the pulling elements takes place already upon a slight opening of the device shell or upon a removal over a short distance of the escape filter device from the device shell.

The pulling elements may be designed, for example, as inflexible. The pulling elements designed as inflexible, the pulling element fastening devices on the closing elements as well as the pulling element holding devices on the inner side of the device shell, for example, may be designed and coordinated with one another in such a way that the second fastening elements of the pulling elements automatically lock on the pulling element holding devices upon reaching the mounting position, i.e., shortly before the closing of the device shell. In an escape filter device system of such a design, the mounting position preferably also corresponds to the complete closing position or approximately the complete closing position of the device shell.

Furthermore, a method, which is characterized in that at least one pulling element is designed as flexible, that the first fastening section of the at least one pulling element is designed as a first barb, that the second fastening section of the at least one pulling element is designed as a second barb on the at least one pulling element, that at least one closing element has a pulling element fastening device with an opening, and that at least one pulling element holding device with an opening is provided on the inner side of the device shell, especially on the device shell top side or on the device shell bottom side, is preferred. The method is characterized in that a first end of a pulling element is pulled through the opening of the pulling element fastening device of a closing element until the first barb of this pulling element is pulled through the opening of the pulling element fastening device, and that subsequently the second end of the same pulling element is pulled through the opening of a pulling element holding device for creating the fastening distance until the second barb of this pulling element is pulled through the opening of this pulling element holding device. Preferably, two such pulling elements are used and the respective closing elements are coupled with the inner side of the device shell via these two pulling elements.

The pulling element fastening device on at least one closing element is preferably designed as a locking funnel. The first and second barbs of a pulling element are preferably designed as flexible in such a way that they can each be guided in one direction through the funnel into the other pulling direction; however, because of their shape and the spreading apart from one another after the guiding through a locking funnel, they stop at the locking funnel. A closing element is finally coupled with a pulling element holding device, when the first barb is held at the first end of the pulling element in at least one first pulling direction on the pulling element fastening device, especially on the locking funnel of the closing element, and the pulling element is arranged on the inner side of the device shell in such a way that it is held on the inner side of the device shell by its second barb in at least one second pulling direction that is opposed or approximately opposed to the first pulling direction. After the fastening of the fastening sections of a pulling element to a closing element and on the inner side of the device shell, the pulling element lies in the device shell between the first closing element of the inner side of the device shell with a defined length, i.e., a defined fastening distance between the two fastening sections of the pulling element. The function of the pulling elements is then activated.

Further, a method, in which at least one of the pulling elements has a stopping element between its barbs, wherein the stopping element stops at the pulling element holding device after pulling the second barb of the at least one pulling element through the corresponding pulling element holding device on the inner side of the device shell and prevents a further pulling of this pulling element through the opening of the pulling element holding device, is preferred. As a result, it is ensured that due to the pulling element being pulled too far through the pulling element holding device on the inner side of the device shell, the closing element is already pulled out of the filter during the mounting process of the escape filter device system. Preferably, the stopping element is arranged very close to the second fastening element, especially to the second fastening element designed as an elastic barb, on the pulling element. As a result, it is ensured that after guiding the second barb through the pulling element holding device, the stopping element subsequently immediately stops at the pulling element holding device and thus prevents a further pulling of the pulling element through the pulling element holding device.

Further features, advantages and details of the present invention appear from the following description, in which exemplary embodiments of the present invention are described in detail with reference to the drawings. In this case, the features mentioned in the claims and in the description are each essential to the present invention individually by themselves or in any combination. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
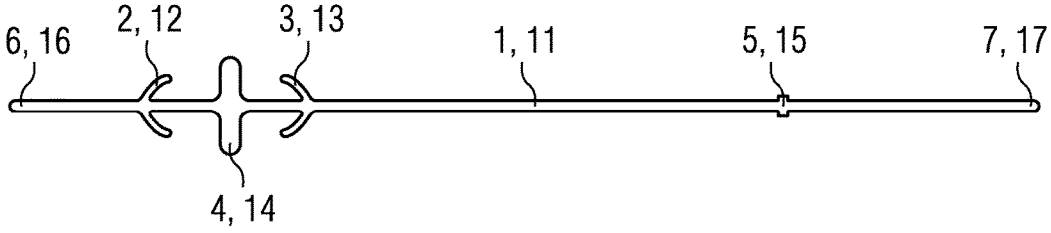
FIG. 1 is a top view of a pulling element according to the present invention designed as a pulling strap.

Referring to the drawings, elements having identical function and mode of action are each provided with identical reference numbers in FIG. 1 through 8.

FIGS. 1 through 8 below shall illustrate the opening mechanism of an escape filter device system and an over-view for the mounting of an escape filter device system into a device shell of an escape filter device system.

FIG. 1 schematically shows a top view of a pulling element 1, 11, which is used for pulling a closing element 20, 30 out of a filter 40 of an escape filter device 50. The pulling element 1, 11 is designed as flexible, especially as a fabric pulling strap and has a first end 6, 16 as well as a second end 7, 17. Furthermore, the pulling element 1, 11 has a first fastening section 2, 12 and a second fastening section 3, 13. The fastening sections 2, 3, 12, 13 are preferably designed as flexible barbs in the pulling strap 1, 11. A stopping element 4, 14 is arranged on the pulling element 1, 11 between the two fastening sections 2, 3, 12, 13. The fastening sections 2, 3, 12, 13 as well as the stopping element 4, 14 are arranged close to the first end 6, 16 of the pulling element 1, 11. At the so-called long second end 7, 17, a mounting control element 5, 15 is arranged close to the end of the pulling element 1, 11. The mounting control element 5, 15 is used for marking the achieving of the correct mounting of the pulling element 1, 11 on a closing element 20, 30 and on an inner side 110, 120 of a device shell 100 of an escape filter device system 70.

Figure 2:
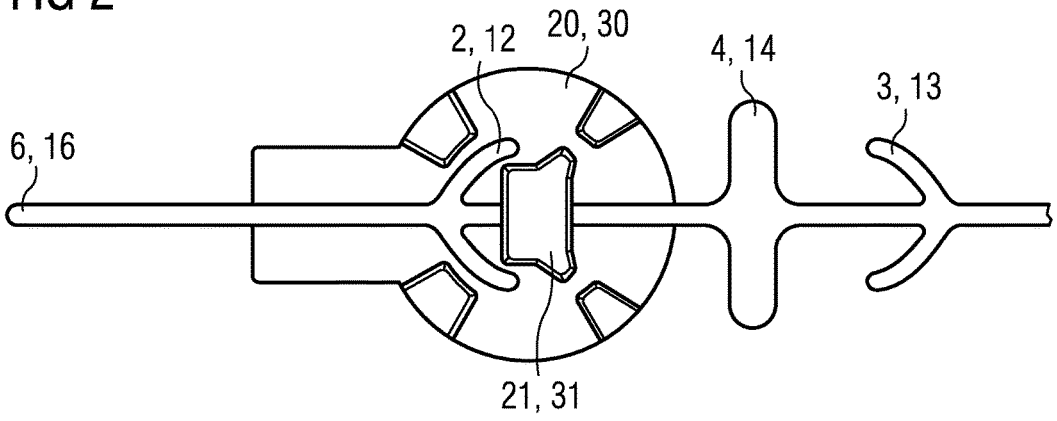
FIG. 2 is a top view of the pulling strap according to FIG. 1 fastened to a closing element.

FIG. 2 schematically shows the fastening of the first end 6, 16 of a pulling element 1, 11 to a closing element 20, 30. The closing element 20, 30 is used for sealing a filter inlet side or a filter outlet side of a filter 40 of an escape filter device 50 in a gas-tight manner. The closing element 20, 30 is preferably designed as a plug, especially as a rubber plug. On the closing element 20, 30 is provided a pulling element fastening device 21, 31, especially in the form of a locking funnel. For fastening the pulling element 1, 11 to the closing element 20, 30, the pulling element 1, 11 is pulled, beginning with the first end 6, 16, through the pulling element fastening devices 21, 31. Reference number 22 indicates the fastening pulling direction of the pulling element 1, 11, i.e., of the first end 6, 16 of the pulling element 1, 11 through the locking funnel 21, 31. The pulling element 1, 11 is pulled through the locking funnel 21, 31 until the first fastening section 2, 12, which is designed as a flexible barb, of the pulling element 1, 11 has been pulled through the locking funnel 21, 31. Because of its flexible design, namely comprising a snap-in element configuration, the first fastening section 2, 12 can be pulled through the locking funnel 21, 31. After the pulling through, the flexible barbs 2, 12 spread apart from one another, so that the pulling element 1, 11 can no longer be pulled in a direction opposite to the fastening pulling direction 22. The flexible barb 2, 12 then stops on the outer side of the locking funnel 21, 31. The second fastening section 3, 13 of the pulling element 1, 11 is likewise designed as a flexible barb, namely comprising a snap-in element configuration, wherein the orientation of the barb is opposite the orientation of the first barb 2, 12, so that the second barb 3, 13 can be pulled, in a pulling direction opposite to the fastening pulling direction 22, through a pulling element holding device 111, 121 (which is not shown) on the inner side 110, 120 of a device shell 100 and held on same.

Figure 3:
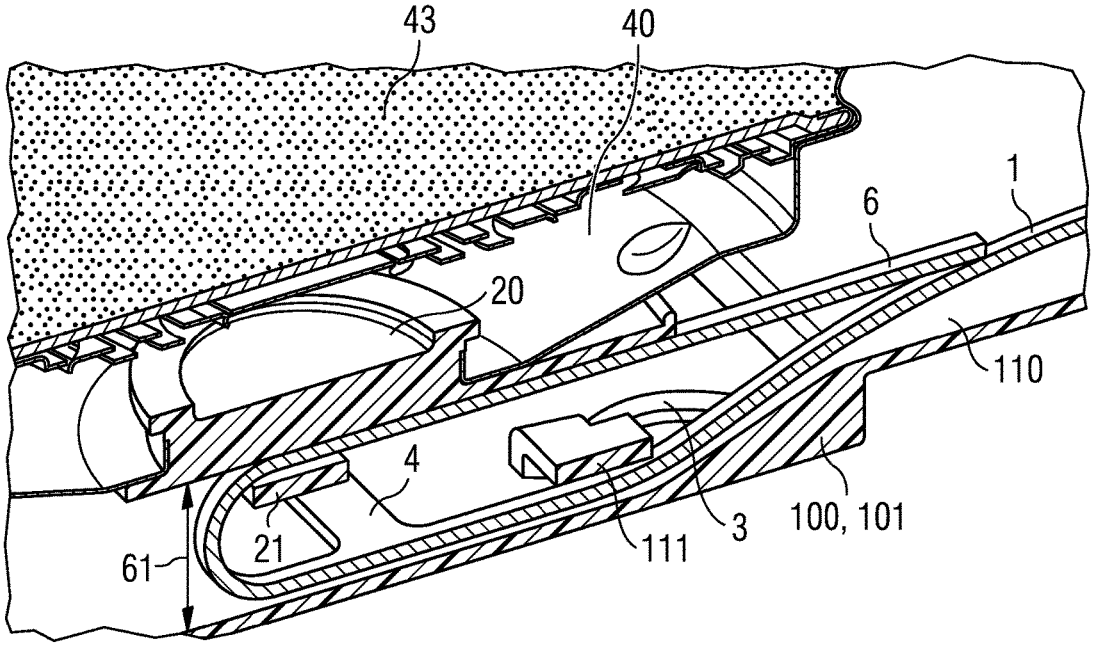
FIG. 3 is a detail view of a detail of the perspective sectional view taken at the cross sectional plane of FIG. 4, with the perspective at a different angle from that of FIG. 4, showing the coupling between a closing element and the inner side of a device shell by means of a pulling element.

FIG. 3 schematically shows in a perspective view the coupling between a first closing element 20 and the inner side 110 of a device shell bottom side 101 of a device shell 100 of an escape filter device system 70 by means of a first pulling element 1. The first closing element 20, which is preferably designed as a rubber plug, seals, for example, the filter inlet side 42 of the filter 40 in a gas-tight manner. The first end 6 of the pulling element 1 has been pulled through the opening of the pulling element fastening device 21, so that the first fastening section 2 of the first pulling element 1 is fastened to the pulling element fastening device 21. The first pulling element 1, which is designed as flexible, has been deflected and guided along the inner side 110 of the device shell bottom side 101, wherein the second fastening section 3 of the pulling element 1 has already been pulled through the pulling element holding device 111, designed as a locking funnel, on the inner side 110 of the device shell bottom side 101. Thus, the second fastening section 3 of the pulling element 1 is fastened to the pulling element holding device 111 on the inner side 110 of the device shell bottom side 101. In the fastened state, the two fastening sections 2, 3 of the pulling element 1 have a short fastening distance to one another, preferably less than 10 cm, especially less than 6 cm. The filter 40 advantageously has Hopcalite 43 in its interior.

In the view shown in FIG. 3, the escape filter device 50 and thus the filter 40 of the escape filter device 50 are located in a resting position 60 within the device shell 100 of the escape filter device system 70. In this resting position 60, the escape filter device 50 or the filter 40 is arranged with a resting distance 61 to the device shell 100.

The mounting of the escape filter device 50 on the device shell bottom side 111 preferably takes place as follows: The folded-together hood, not shown in this FIG. 3, is held together with the filter 40, the closing element 20 installed in the filter 40 and the pulling strap 1 already mounted on the closing element 20, so that the pulling strap 1 with the long side, i.e., with the second end 7, is inserted into the locking funnel 21 on the inner side 110 of the device shell bottom side 111. After the insertion of the pulling strap 1 through the locking funnel 21, the folded-together hood and the filter 40 integrated into the hood can be positioned in the device shell bottom side 101.

Figure 4:
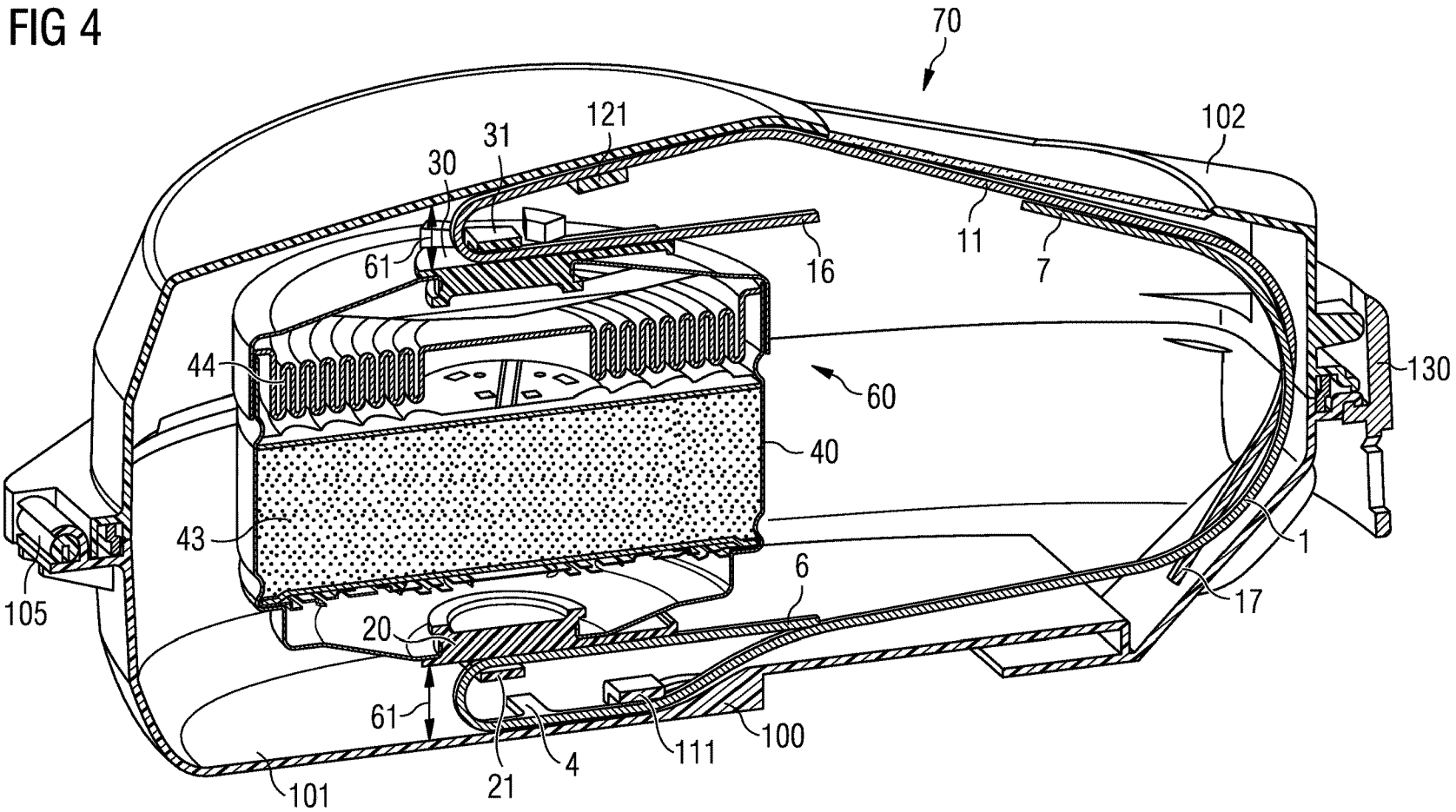
FIG. 4 is a perspective sectional view taken along a cross sectional plane passing through a central region of the escape filter device system, showing an escape filter device system, which is designed according to the design principle according to the present invention, and with the hood of the escape filter device not shown for the sake of clarity.

FIG. 4 shows the arrangement of a filter 40, having Hopcalite 43 and an additional filter element 44, in the resting position 60 within a closed device shell 100 of an escape filter device system 70. The hood of the escape filter device 50 is not shown for the sake of clarity. In the resting position 60, the escape filter device 50 or the filter 40 of the escape filter device 50 is arranged with a resting distance 61 of a few cm, especially with less than 5 cm, to the device shell bottom side 101 and the device shell top side 102. The device shell 100 has a closing element 130 for closing and opening the device shell 100, especially for closing and opening the device shell bottom side 101 and the device shell top side 102. The device shell top side 102 is mounted pivotably on the device shell bottom side 101 via a hinge 105. As a result, a defined opening movement of the two device shell sides 101, 102 is predetermined. The pulling strap 1 from FIG. 1 is guided on the "long side" of the pulling strap 1 outwards in the direction of the closing element 130. The pulling strap 1 is pulled at its second end 7 until the stopping element 4 of the pulling strap 1 stops on the outer side of the pulling element holding device 111. The stop of the stopping element 4 at the pulling element holding device 111 designed as a locking funnel means that the flexible second barb 3 of the pulling strap 1 is locked at the pulling element holding device 111. After the fastening or locking of the second fastening section 3 at the pulling element holding device 111 on the device shell bottom side 101, the fastening sections on the first pulling strap 1 facing the pulling element fastening device 21 on the closing element 20 and the pulling element holding device 111 on the device shell bottom side 101 have reached their end position. From this time, the function of the pulling strap 1 is activated and a removal of the escape filter device 50 from the device shell bottom side 101 is no longer possible without a pulling out of the first closing element 20 from the filter 40 and a partial activation of the filter 40 associated with it.

Figure 8:
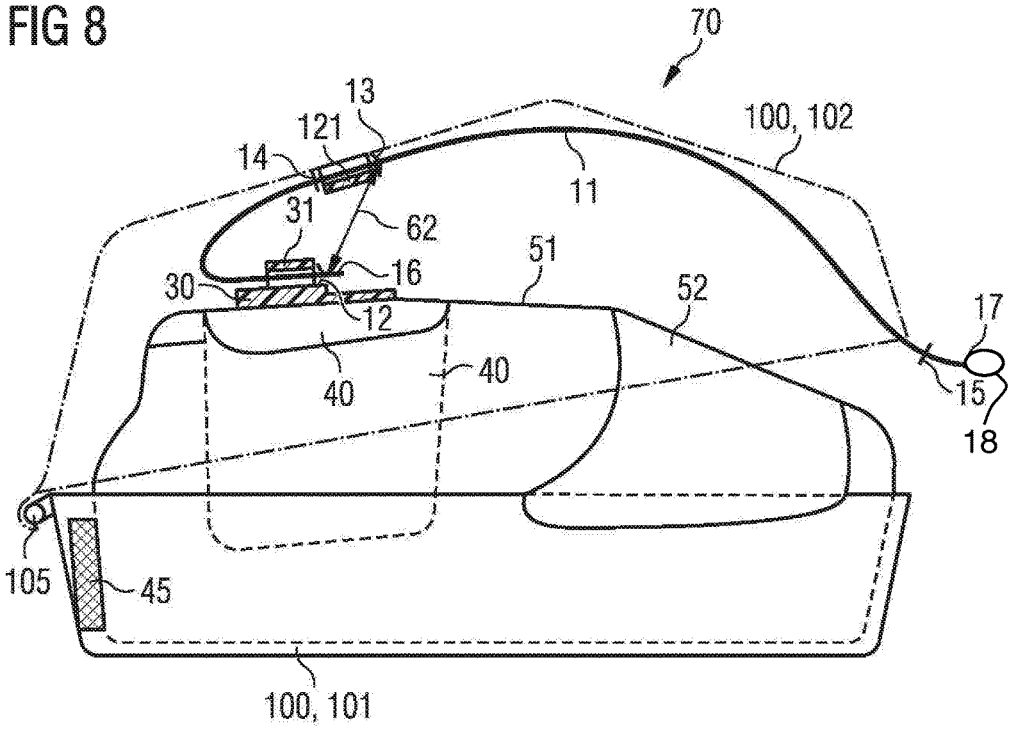
FIG. 8 is a schematic view showing an escape filter device system in a side view with interior features shown in section, taken along a cross sectional plane passing through a central region of the escape filter device system, wherein the mounting position of the device shell is shown.

The clearly fastened position of the pulling strap 1 on the device shell bottom side 101 can be indicated by the mounting control element 5, shown in FIG. 1, which is preferably an optical marking, on the pulling strap 1 outside of the device shell 100, see FIG. 8. The pulling strap 1 protruding from the device shell 100 can either be positioned in the device shell bottom side 101 in such a way that there is no hindrance upon opening the device shell 100 and removing the escape filter device 50. It is also conceivable that the pulling strap 1 is shortened at a suitable point after the mounting of the escape filter device system 70.

Figure 5:
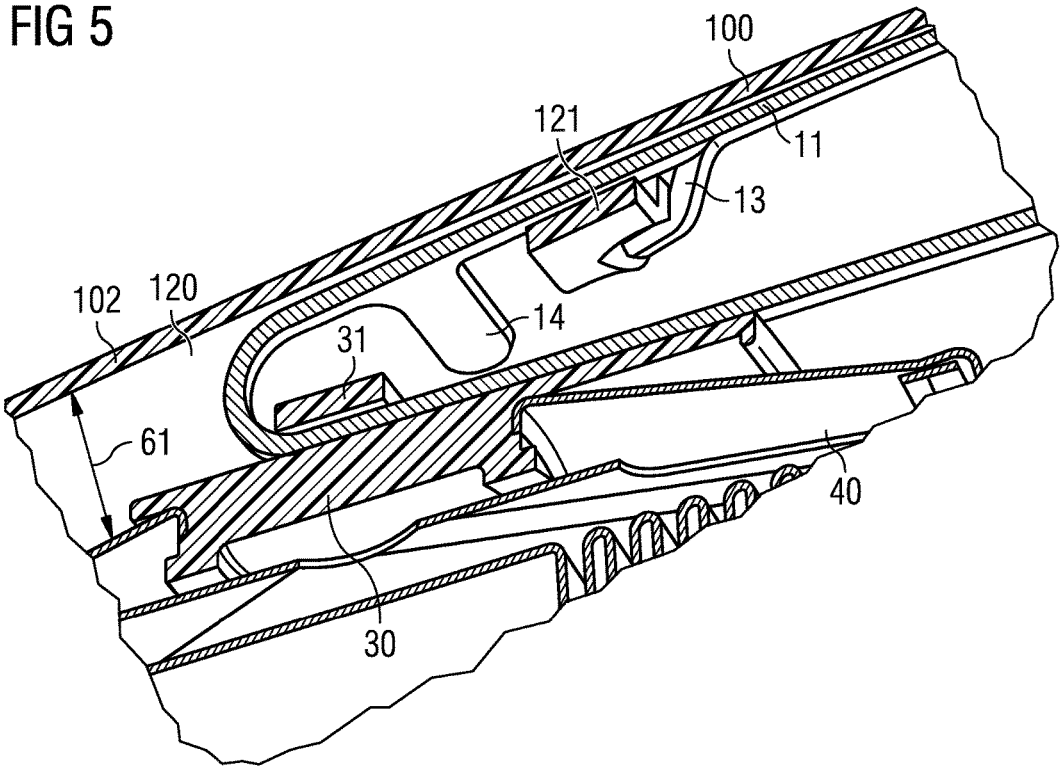
FIG. 5 is a detail view of a detail of the perspective sectional view taken at the cross sectional plane of FIG. 7, with the perspective at a different angle from that of FIG. 7, showing the coupling between a closing element and a device shell top side of a device shell by means of a pulling element.

The escape filter device 50 positioned in the device shell bottom side 101 can additionally be retained on the device shell bottom side 101 by a retaining device 140. This retaining device 140 advantageously has closable Velcro elements, which are used for the escape filter device 50 to not simply fall out of the device shell bottom side 101 and possibly be damaged after the removal of the device shell top side 102 from the device shell bottom side 101. In case of a removal of the escape filter device 50 from the device shell bottom side 101, the retaining device 140 is automatically opened by the removal force applied and thereby does not hinder the removal of the escape filter device 50 from the device shell bottom side 101. The coupling of the second closing element 30 by means of the second pulling element 11 on the device shell top side 102 is schematically shown in FIG. 5. Here, the second pulling element 11 is also designed as a flexible pulling strap. After the fastening of the first fastening section 12 to the second closing element 30, the second end 17 of the second pulling strap 11 is guided through the pulling element holding device 121, designed as a locking funnel, on the inner side 120 of the device shell top side 102. The device shell top side 102 is moved up to the mounting position, i.e., up to shortly before the final closing of the device shell sides 101, 102, so that the guiding of the second pulling strap 11 on the long side of the pulling strap 11 outwards, i.e., in the direction of the closing element 130, is barely possible. In the mounting position, the second pulling strap 11 is pulled at its second end 17 until the stopping element 14 stops at the pulling element holding device 121, which is designed as a locking funnel. It is ensured by the stopping of the stopping element 14 that the second barb 13, which has a flexible design, of the second pulling element 11 was pulled through the locking funnel 121 and thus has reached its fastening position. From this time, the function of the second pulling strap 11 is likewise activated and the opening of the device shell 100, especially the opening of the device shell top side 102 from the device shell bottom side 101, as well as a removal of the escape filter device 50 from the device shell 100 without an activation of the filter 40, i.e., a removing of the closing elements 20, 30, is no longer possible. The fact that the second pulling strap 11 has likewise taken up the clearly fastened position in relation to the device shell top side 102 or the pulling element holding device 121, can likewise be indicated by a mounting control element 15, see FIG. 1, on the second pulling strap 11 outside the device shell 100. In this case, the protruding second strap 11 may also be positioned in the device shell 100 such that there is no hindrance upon opening the device shell 100 and upon removal of the escape filter device 50. Also the protruding part of the second pulling strap 11 may be shortened, for example, cut off at a suitable point. After the activation of the two pulling elements 1, 11 in the mounting position, the device shell 100 is closed, especially by means of the closing element 130. In addition, the closed device shell 100 can be secured against unintentional opening by means of a seal as an indicator.

Figure 6:
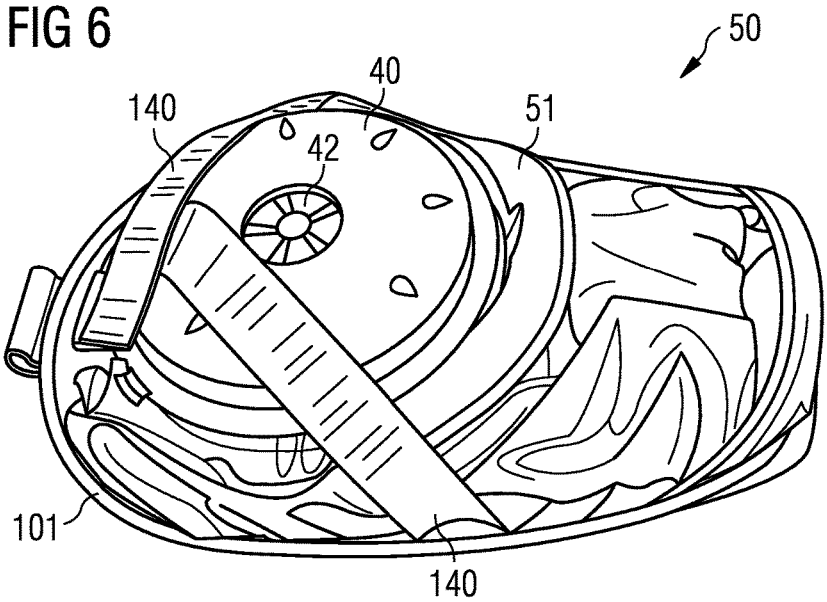
FIG. 6 is a perspective view showing an arrangement of an escape filter device in a device shell bottom side of a device shell of an escape filter device system.
Figure 7:
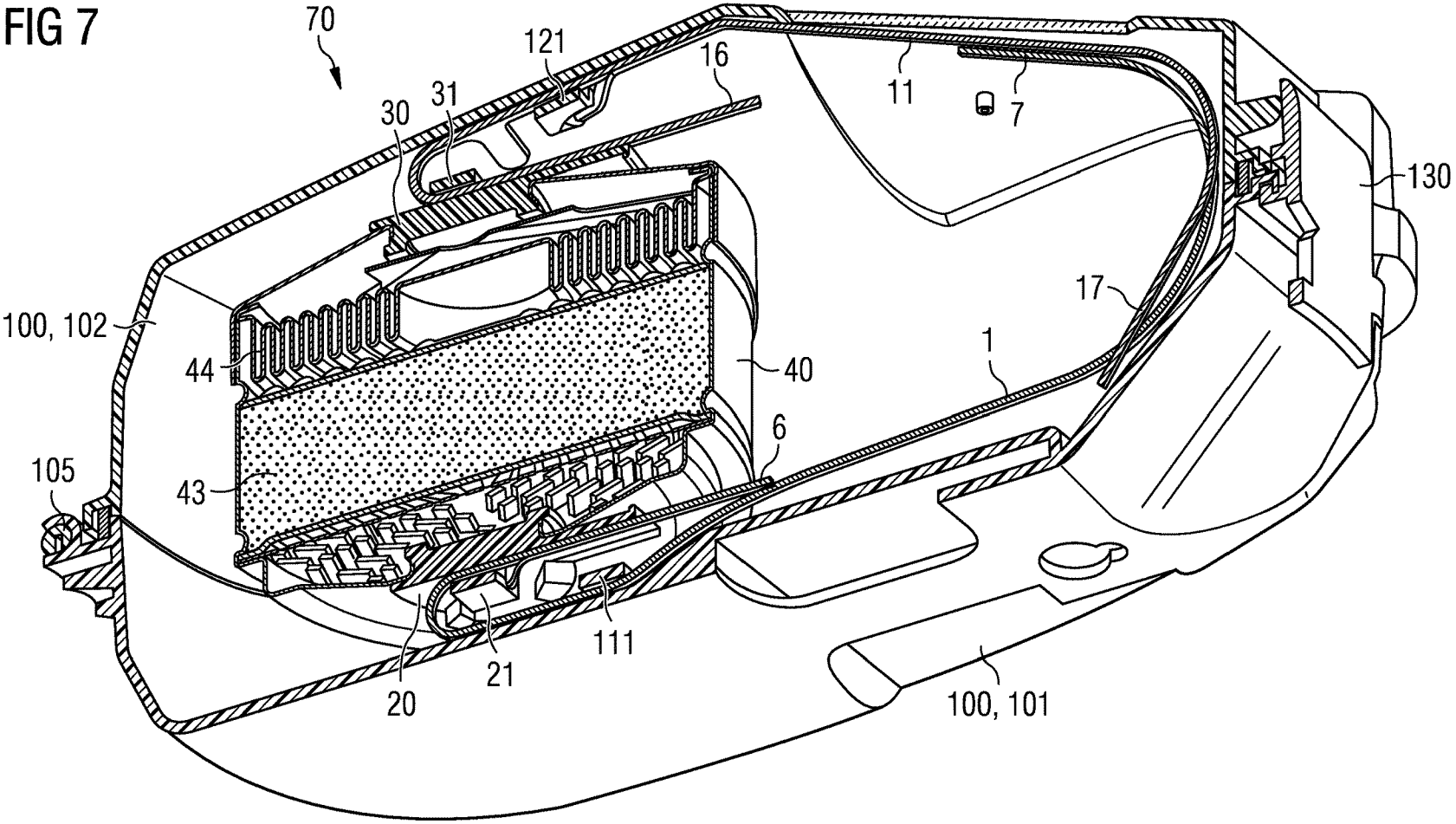
FIG. 7 is a perspective sectional view taken along a cross sectional plane of FIG. 4 and rotated clockwise around a horizontal axis and vertical axis relative to FIG. 4, showing a filter device system, which is designed according to the design principle according to the present invention, and with the hood of the escape filter device not shown for the sake of clarity.

FIG. 7 shows in a perspective view a section through an escape filter device system 70. For better recognition of the pulling elements 1, 11, the hood of the escape filter device 50 is not shown, but only the filter 40. The closing element 130 is used, on the one hand, for closing the device shell 100, i.e., for closing the device shell top side 102 on the device shell bottom side 101. At the same time, the closing element 130 is also used for opening the device shell 100. For closing, the closing element 130 can connect the device shell sides 101, 102 via a snap connection in a positive-locking manner. The closing element 130 may be designed as an opening strap which can be pulled in order to remove the device shell top side 102 from the device shell bottom side 101. As an alternative thereto, a special opening strap may be arranged on the closing element 130. The closing element 130 has to be pulled for using the escape filter device 50, which is arranged in the resting position 60 within the device shell 100 of the escape filter device system 70. In this connection, the device shell top side 102 is pivoted to the device shell bottom side 101 until the second closing element 20 is pulled out of the filter 40 due to the tension of the second pulling element 11 between the pulling element fastening device 121 on the closing element 20 and the pulling element holding device 121 on the device shell top side 102. I.e., due to the opening of the device shell top side 102, a defined opening force of the second pulling element 11 acts on the second closing element 30 by means of a force deflection and removes this second closing element 30 from the filter 40, for example, the filter inlet side 42 of the filter 40. In order to produce a counterforce for removing the second closing element 30, which is preferably designed as a rubber plug, from the filter 40, the filter 40 or the entire escape filter device 50 is fixed on the device shell bottom side 101 by means of the retaining device 140, as FIG. 6 shows. Thus, the second closing element 30 is removed by the opening movement of the device shell top side 102 from the filter 40 and, for example, the filter inlet side 42 of the filter 40 is activated. Subsequently, the user grasps the escape filter device 50 to remove it from the device shell bottom side 101. By removing the escape filter device 50, the retaining device 140 automatically opens. Upon reaching a defined removal distance, which is greater than the fastening distance 62 of the two fastening sections 2, 3 of the first pulling element 1, the first closing element 20 is retained by the first pulling element 1 in the device shell bottom side 101 on the filter 40, especially on the filter outlet side 42 of the filter 40. I.e., due to the pulling out of the escape filter device 50, the second closing element 30 is separated from the filter 40 and thus also activates the second filter side, especially the filter outlet side 42. The escape filter device is now automatically completely ready for use without the user having to take further actions on the escape filter device 50. The retaining device 140 additionally takes over the function of holding the hood of the escape filter device 50 after opening the device shell top side 102 in the resting position in the device shell bottom side 101 in order to avoid an unintentional falling out of the filter device from the device shell bottom side 101 and thus to prevent possible damage of the escape filter device.

FIG. 8 schematically shows an escape filter device system 70 in a side view. The escape filter device 50 has a filter 40 as well as a hood 51 with a window 52 and with an exhalation valve 45. The escape filter device 50 is positioned in a resting position 60 in the device shell bottom side 101 of the device shell 100. The device shell top side 102 is not entirely closed. I.e., in this position the device shell top side 102 has reached the mounting position of the second pulling element 11. The second pulling element 11 is pulled at its second end 17, which may have a gripping element 18 embodied by a loop at the end 17 of the pulling element 11, so far out of the gap between the device shell bottom side 101 and the device shell top side 102 that the mounting control element 15 is visible. In this position of the mounting control element 15, it is ensured that the second fastening section 13, which is designed as a flexible barb, of the second pulling element 11 has been pulled through the pulling element holding device 121 designed as a locking funnel and the stopping element 14 is stopped at the pulling element holding device 121. After the recognizing of the mounting control element 15, the second end 17 of the second pulling element 11 can be inserted into the interior of the device shell 100 and the device shell 100 can be completely closed by the closing element 130. The two pulling elements 1, 11 are thereby activated and an opening of the device shell 100 is no longer possible without an activation of the filter 40.

The above explanation of the embodiments describes the present invention exclusively within the framework of examples. Of course, individual features of the embodiments, if technically useful, can be freely combined with one another, without going beyond the concepts of the present invention.

While specific embodiments of the invention have been shown and described in detail to illustrate the application of the principles of the invention, it will be understood that the invention may be embodied otherwise without departing from such principles.

The invention claimed is:

1. A pulling element for pulling a closing element out of a filter of an escape filter device, which is arranged in a device shell in a resting position with a resting distance to the device shell, wherein the escape filter device is moveable into a removal position with an increased removal distance to the resting distance, the pulling element comprising:

a first fastening section for fastening the pulling element to the closing element; and a second fastening section for fastening on an inner side of the device shell, wherein the two fastening sections have a fastening distance to one another, which is smaller than or equal to the removal distance.

2. A pulling element in accordance with claim 1, wherein the pulling element is inflexible.

3. A pulling element in accordance with claim 1, wherein the pulling element is flexible.

4. A pulling element in accordance with claim 1, wherein at least one of the first fastening section and the second fastening section comprises a snap-in element.

5. A pulling element in accordance with claim 1, wherein at least one of the first fastening section and the second fastening section comprises flexible barbs.

6. A pulling element in accordance with claim 1, further comprising a stopping element between the first fastening section and the second fastening section.

7. A pulling element in accordance with claim 1, further comprising at least one of a mounting control element and a gripping element at one end of the pulling element.

8. An escape filter device comprising:

a hood;

a filter, which has a filter inlet side and a filter outlet side, integrated into the hood;

a closing element; and a pulling element for pulling out the closing element from the filter, wherein the filter inlet side or the filter outlet side is closed in a gas-tight manner by means of the closing element and the pulling element is arranged on the closing element, the escape filter device is arranged in a device shell in a resting position with a resting distance to the device shell, and the escape filter device is moveable into a removal position with an increased removal distance to the resting distance, the pulling element comprising:

a first fastening section for fastening the pulling element to the closing element; and a second fastening section for fastening on an inner side of the device shell, wherein the two fastening sections have a fastening distance to one another, which is smaller than or equal to the removal distance.

9. An escape filter device in accordance with claim 8, wherein the closing element is a first closing element that closes the filter inlet side and the pulling element is a first pulling element and further comprising:

a second closing element closing the filter outlet side; and a second pulling element for pulling out the second closing element from the filter, the second pulling element being arranged on the second closing element, the second pulling element comprising a second pulling element first fastening section for fastening the second pulling element to the second closing element and a second pulling element second fastening section for fastening the second pulling element on an inner side of the device shell, a distance from the second pulling element first fastening section to the second pulling element second fastening section being smaller than or equal to the removal distance.

10. An escape filter device system, comprising:

a device shell having a first inner side and a second inner side;

an escape filter device comprising:

a hood;

a filter, which has a filter inlet side and a filter outlet side, integrated into the hood;

a closing element; and a pulling element for pulling out the closing element from the filter, wherein the filter inlet side or the filter outlet side is closed in a gas-tight manner by means of the closing element and, the pulling element comprises a first fastening section for fastening the pulling element to the closing element and a second fastening section, wherein the two fastening sections have a fastening distance to one another, which is smaller than or equal to a removal distance between the device shell and the escape filter device; and a pulling element holding device, wherein:

the escape filter device is arrangeable in a resting position in the device shell and the device shell is openable for transferring the escape filter device into a removal position; and the pulling element holding device is arranged on one of the first inner side and the second inner side of the device shell for fastening the second fastening section of the pulling element to the pulling element holding device, wherein the pulling element and the pulling element holding device are configured and are coordinated with one another such that the closing element is automatically pulled out of the filter during the opening of the device shell upon reaching the removal distance between the device shell and the escape filter device.

11. An escape filter device system in accordance with claim 10, wherein the device shell has a device shell bottom portion with the first inner side and a device shell top portion with the second inner side, which top portion and bottom portion are pivotably connected to one another.

12. An escape filter device system in accordance with claim 11, wherein the device shell bottom side and the device shell top side are designed as hard components.

13. An escape filter device system in accordance with claim 12, further comprising a spring element arranged to press against the device shell bottom portion and the device shell top portion with the device shell being closed.

14. An escape filter device system in accordance with claim 11, wherein the device shell has a closing element for closing and opening the device shell bottom portion and the device shell top portion.

15. An escape filter device system in accordance with claim 10, further comprising a guide on the inner side of the device shell for guiding the pulling element.

16. An escape filter device system in accordance with claim 10, further comprising a retaining device for retaining the escape filter device.

17. An escape filter device system in accordance with claim 10, wherein:

the closing element is a closing element that closes the filter inlet side and the pulling element is a first pulling element;

the pulling element holding device is a first pulling element holding device;

the escape filter device further comprises: a second closing element closing the filter outlet side; and a second pulling element for pulling out the second closing element from the filter;

the escape filter device system further comprises a second pulling element holding device;

the second pulling element holding device is arranged on the other of the first inner side and the second inner side;

the second pulling element comprises a second pulling element first fastening section for fastening the second pulling element to the second closing element; and a second pulling element second fastening section for fastening the second pulling element to the second pulling element holding device, wherein the two second pulling element fastening sections have a fastening distance to one another, which is smaller than or equal to the removal distance between the device shell and the escape filter device, whereby the second pulling element and the second pulling element holding device are configured and are coordinated with one another such that the second closing element is automatically pulled out of the filter during the opening of the device shell upon reaching the removal distance between the device shell and the escape filter device.

18. A method for mounting an escape filter device system the method comprising the steps of:

providing an escape filter device comprising a hood, a filter, which has a filter inlet side and a filter outlet side, integrated into the hood, a first closing element, a second closing element, a first pulling element and a second pulling element, each pulling element comprising a first fastening section for fastening the pulling element to the closing element and a second fastening section for fastening on an inner side of a device shell, wherein the two fastening sections have a fastening distance to one another, which is smaller than or equal to a removal distance;

providing the device shell, in which the escape filter device is arrangeable in a resting position and which is openable for transferring the escape filter device into a removal position;

fastening the first fastening section of the first pulling element to the first closing element;

fastening the second fastening section of the first pulling element to a first pulling element holding device at a first position on the inner side of the device shell;

fastening the first fastening section of the second pulling element to the second closing element;

closing the device shell until reaching a mounting position, wherein the device shell is not yet completely closed in the mounting position, and with the device shell in the mounting position, fastening the second fastening section of the second pulling element to a second pulling element holding device at a second position on the inner side of the device shell; and closing the device shell completely.

19. A method in accordance with claim 18, wherein:

the first pulling element is designed as a flexible pulling element;

the first fastening section of the first and second pulling elements is designed as a first barb and the second fastening section of the at least one of the first and second pulling elements is designed as a second barb;

the first closing element has a pulling element fastening device with an opening; and a first end of the at least one of the first and second pulling elements is pulled through the opening of the pulling element fastening device of the first closing element until the first barb is pulled through the opening of the pulling element fastening device and subsequently the second end of the at least one of the first and second pulling elements is pulled through an opening of the first pulling element holding device for creating the fastening distance until the second barb of the at least one of the first and second pulling elements is pulled through the opening of the first pulling element holding device.

20. A method in accordance with claim 19, wherein the at least one of the first and second pulling elements has a stopping element between the first and second barbs, wherein after the pulling of the second barb of the at least one of the first and second pulling elements through the first pulling element holding device on the inner side of the device shell, the stopping element stops at the pulling element holding device and prevents a further pulling of the at least one of the first and second pulling elements through the opening of the pulling element holding device.

* * * * *